US008984787B1

(12) United States Patent
O'Clair et al.

(10) Patent No.: US 8,984,787 B1
(45) Date of Patent: Mar. 24, 2015

(54) ROTATING AND TRANSLATING EXTRACTOR

(71) Applicant: Smith & Wesson Corp., Springfield, MA (US)

(72) Inventors: Sean O'Clair, Feeding Hills, MA (US); Gary Zukowski, Ludlow, MA (US); Brett Curry, Monson, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 14/065,973

(22) Filed: Oct. 29, 2013

(51) Int. Cl.
*F41A 15/00* (2006.01)

(52) U.S. Cl.
CPC ..... *F41A 15/00* (2013.01)
USPC ..... 42/25

(58) Field of Classification Search
USPC ..... 42/25, 46, 68
See application file for complete search history.

(56) References Cited

U.S. PATENT DOCUMENTS

| | | | | |
|---|---|---|---|---|
| 1,401,552 | A | 12/1921 | Pedersen | |
| 1,423,836 | A | 7/1922 | Declaye | |
| 3,561,396 | A | 2/1971 | Luciani | |
| 3,608,223 | A | 9/1971 | Dieckmann | |
| 3,830,000 | A | 8/1974 | Browning | |
| 4,031,648 | A | 6/1977 | Thomas | |
| 4,615,132 | A * | 10/1986 | Smith | 42/25 |
| 4,653,210 | A * | 3/1987 | Poff, Jr. | 42/16 |
| 4,883,213 | A | 11/1989 | Almeras | |
| 4,920,676 | A | 5/1990 | Peters | |
| 5,289,755 | A | 3/1994 | Zielinski et al. | |
| 5,678,340 | A | 10/1997 | Moon | |
| 5,794,373 | A | 8/1998 | Moon | |
| 6,393,751 | B1 | 5/2002 | Liebenberg | |
| 6,732,465 | B2 * | 5/2004 | Strayer | 42/69.03 |
| 6,851,212 | B2 | 2/2005 | Szabo | |
| 7,257,917 | B1 | 8/2007 | Garland | |
| 7,380,362 | B2 | 6/2008 | Curry et al. | |
| 7,395,626 | B2 | 7/2008 | Zedrosser | |
| 7,874,240 | B2 | 1/2011 | Akhavan | |
| 7,971,380 | B1 | 7/2011 | Gussalli Beretta | |
| 8,745,910 | B2 * | 6/2014 | Zukowski et al. | 42/25 |
| 2006/0185212 | A1 * | 8/2006 | Curry et al. | 42/46 |
| 2012/0167427 | A1 * | 7/2012 | Zukowski et al. | 42/25 |

* cited by examiner

*Primary Examiner* — Reginald Tillman, Jr.
(74) *Attorney, Agent, or Firm* — John A. Chionchio; Ballard Spahr LLP

(57) ABSTRACT

An extractor is mounted on a slide of an auto-loading firearm. The extractor is capable of rotational and translational motion relative to the slide resulting in improved functioning through an increase in flag distance and reduced friction between the extractor and cartridge when the slide moves into battery. The extractor has a cam follower which cooperates with a cam on the slide to maintain the extractor hook in engagement with the rim of the cartridge during extraction. The extractor is biased into engagement with the cam, and a second cam follower on the extractor is engageable with the barrel face when the slide moves into battery.

43 Claims, 5 Drawing Sheets

ROTATING AND TRANSLATING EXTRACTOR

FIELD OF THE INVENTION

This invention relates to auto-loading firearms and particularly, extractors for use therewith.

BACKGROUND

Modern auto-loading pistols having a reciprocating slide mounted atop a frame typically have an extractor mounted on the slide which engages the rim of a chambered cartridge and pulls the cartridge out of the chamber when the slide moves from battery to the open position. Such extractors have a hook positioned at one end which engages the cartridge rim and are pivotably mounted on the slide. To ensure reliable extraction, the hook must engage the cartridge with significant force to prevent the hook from pivoting outwardly and passing over the rim during extraction as the slide moves out of battery. To that end, the extractor is spring biased to force the hook into the rebate of the cartridge. The pivotably mounted extractor also allows the hook to engage a chambered cartridge without breaking because the hook can pivot outwardly from the slide to clear the rim of the chambered cartridge as the slide moves to battery and then snap into the cartridge rebate, ready to extract the cartridge when the slide again moves out of battery.

However, the necessary biasing force on the extractor causes the hook to drag across the rim as the slide moves to battery. Moving contact between the hook and the cartridge generates friction which slows the slide and inhibits slide movement to battery. There is clearly a need to reduce the friction between the hook and cartridge to alleviate the drag problem without compromising the reliability of cartridge extraction.

SUMMARY

The invention concerns an extractor for a auto-loading firearm. In one example embodiment the extractor comprises a body defining a longitudinal axis and having a hook at a first end thereof. A first slot is positioned in the body distal to the first end. The first slot is oriented parallel to the longitudinal axis. A first cam follower is located at the first end.

By way of example, the body further comprises a second end opposite the first end. The first slot is positioned between the first and second ends. In an example embodiment, the first slot extends through the body. By way of further example, the first cam follower is positioned on the hook. In a particular example embodiment, the first cam follower comprises a cam follower surface projecting from the hook transversely to the longitudinal axis. By way of a further example, at least a portion of the cam follower surface is oriented angularly relatively to the longitudinal axis. The portion of the cam follower surface may have an orientation angle of about 45° relatively to the longitudinal axis. In another example, at least a portion of the cam follower surface is oriented substantially parallel to the longitudinal axis. In another example, a second cam follower may be positioned on the hook.

In a further example embodiment, the body further comprises a second slot contiguous with the first slot. The second slot is oriented parallel to the longitudinal axis in this example. A spring is mounted within the second slot by way of example.

The invention further encompasses a slide for an auto-loading firearm. In an example embodiment, the slide comprises an elongate channel formed of a U-shaped sidewall. The channel defines a longitudinal axis. The sidewall has an opening therein. A first cam is positioned on the slide adjacent to the opening. An extractor body is mounted on the example slide and has first and second ends oppositely disposed. The extractor body is movable relatively to the slide in a direction parallel to the longitudinal axis. A first cam follower is located at the first end of the extractor body. The first cam follower is engageable with the first cam. A first spring acts between the slide and the extractor body for biasing the extractor body into engagement with the first cam. A hook is positioned at the first end of the extractor body. The hook is positioned adjacent to the opening in this example. The extractor body is pivotally mounted on the slide for motion of the hook toward and away from the longitudinal axis.

In an example embodiment, the first cam comprises a cam surface positioned on the sidewall and facing toward the longitudinal axis. The cam surface may be angularly oriented with respect to the longitudinal axis by way of example. The cam surface may have an orientation angle of about 45° relatively to the longitudinal axis. An example embodiment may further comprise a recess in the sidewall contiguous with the cam surface. In a particular example embodiment, the cam surface is oriented substantially parallel to the longitudinal axis. By way of example, the slide may further comprising a recess in the sidewall contiguous with the cam surface.

An example embodiment may further comprise a pin mounted on the slide proximate to the opening. A first slot is positioned in the extractor body. The first slot is oriented parallel to the longitudinal axis and receives the pin. The first slot and the pin cooperate to permit pivoting of the extractor body and motion thereof parallel to the longitudinal axis.

In another example embodiment, a second slot is positioned in the extractor body. The second slot is contiguous with the first slot and oriented parallel to the longitudinal axis. The first spring is positioned within the second slot and acts between the pin and the extractor body in this example. By way of example, a second spring is mounted on the slide. In this example the first slot is positioned between the first and second ends of the extractor body. The second spring engages the second end of the extractor body and thereby biases the hook toward the longitudinal axis.

By way of example, the first cam follower is positioned on the hook. In another example, the first cam follower comprising a cam follower surface projecting from the hook transversely to the longitudinal axis. In an example embodiment, at least a portion of the cam follower surface is oriented angularly relatively to the longitudinal axis. By way of example, the portion of the cam follower surface may have an orientation angle of about 45° relatively to the longitudinal axis. In a further example, at least a portion of the cam follower surface is oriented substantially parallel to the longitudinal axis. A second cam follower may be positioned on the hook in another example embodiment.

The invention also encompasses an auto-loading firearm. In an example embodiment, the auto-loading firearm comprises a frame. A barrel is mounted on the frame and has a bore defining a firing axis. A slide is mounted on the frame and is movable relatively thereto along the firing axis between an open position and a battery position. The slide has an opening therein. A first cam is positioned on the slide adjacent to the opening. An extractor body is mounted on the slide and has first and second ends oppositely disposed. The extractor body is movable relatively to the slide in a direction parallel to the firing axis. A first cam follower is located at the first end of the extractor body. The first cam follower is engageable with the first cam. A first spring acts between the slide and the extractor body for biasing the extractor body toward the barrel and into engagement with the first cam. A hook is positioned at the first end of the extractor body. The hook is positioned adjacent to the opening. The extractor body is pivotally mounted on the slide for motion of the hook toward and away from the firing axis.

By way of example, the first cam comprises a cam surface positioned on the sidewall and facing toward the firing axis. In an example embodiment, the cam surface is angularly oriented with respect to the firing axis. For example, the cam surface may have an orientation angle of about 45° relatively to the firing axis. Another example further comprises a recess in the sidewall contiguous with the cam surface. In a particular example embodiment, the cam surface is oriented substantially parallel to the firing axis. By way of example, a recess may be positioned in the sidewall contiguous with the cam surface.

In another example embodiment, the auto-loading firearm further comprises a pin mounted on the slide proximate to the opening. A first slot is positioned in the extractor body. The first slot is oriented parallel to the firing axis and receives the pin. The first slot and the pin cooperate to permit pivoting of the extractor body and motion thereof parallel to the firing axis.

By way of example, the auto-loading firearm further comprises a second slot positioned in the extractor body. The second slot is contiguous with the first slot and oriented parallel to the firing axis. The first spring is positioned within the second slot and acts between the pin and the extractor body. In another example, the auto-loading firearm further comprises a second spring mounted on the slide. In this example, the first slot is positioned between the first and second ends of the extractor body. The second spring engages the second end of the extractor body and thereby biases the hook toward the firing axis. By way of example, the first cam follower is positioned on the hook. In another example, the first cam follower comprises a cam follower surface projecting from the hook transversely to the firing axis. By way of example, at least a portion of the cam follower surface is oriented angularly relatively to the firing axis. For example, the portion of the cam follower surface may have an orientation angle of about 45° relatively to the firing axis. In another example embodiment, at least a portion of the cam follower surface may be oriented substantially parallel to the firing axis. The example may further comprise a second cam follower positioned on the hook. The second cam follower is engageable with the barrel. By way of example, the auto-loading firearm comprises a pistol.

DETAILED DESCRIPTION

Figure 1:
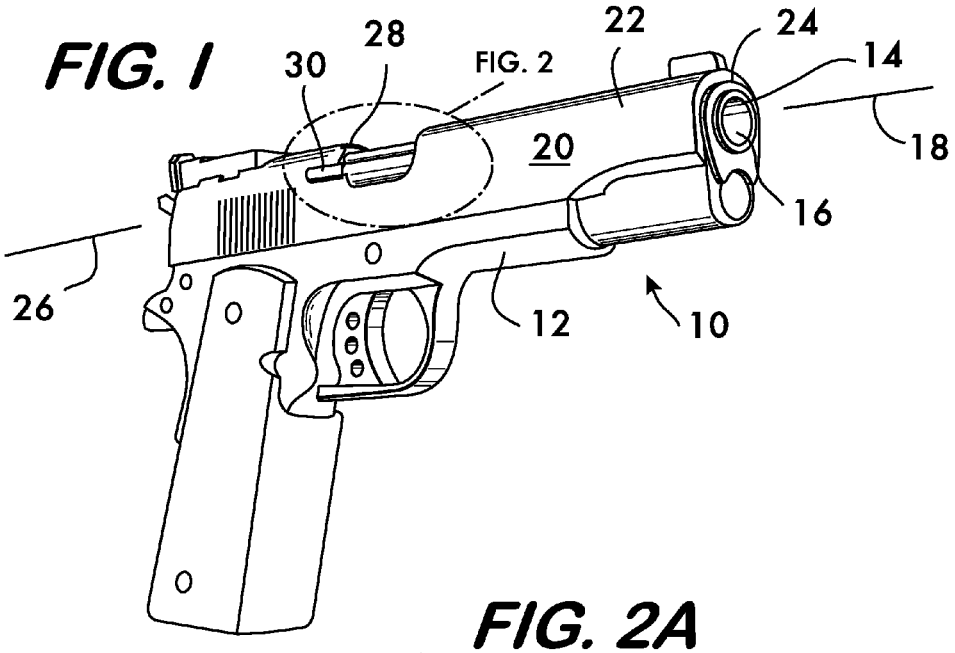
FIG. 1 is an isometric view of an example firearm according to the invention.

FIG. 1 shows an example auto-loading pistol 10 having a frame 12 and a barrel 14 mounted on the frame. Barrel 14 has a bore 16 which defines a firing axis 18. A slide 20 is mounted on the frame 12. The slide is movable relatively to the frame 12 along firing axis 18 between an open position and a closed or "battery" position (shown). Slide 20 in this example takes the form of an elongate channel 22 formed of a U-shaped side wall 24. The channel 22 defines a longitudinal axis 26 which, in this example, is coincident with the firing axis 18. An opening 28 is positioned in the side wall 24 of channel 22. Opening 28 is an ejector port which permits cartridges, or casings from spent cartridges, to be ejected from the pistol 10 when the slide moves to the open position to extract and eject a cartridge.

Figure 2A:
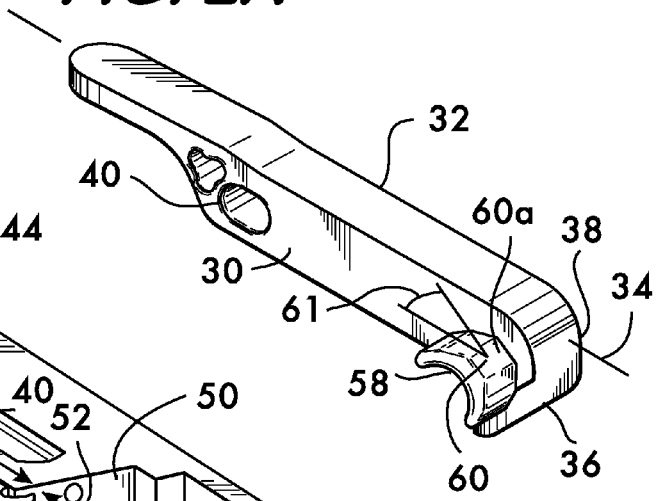
FIG. 2A is a detailed view of an example component according to the invention.
Figure 2:
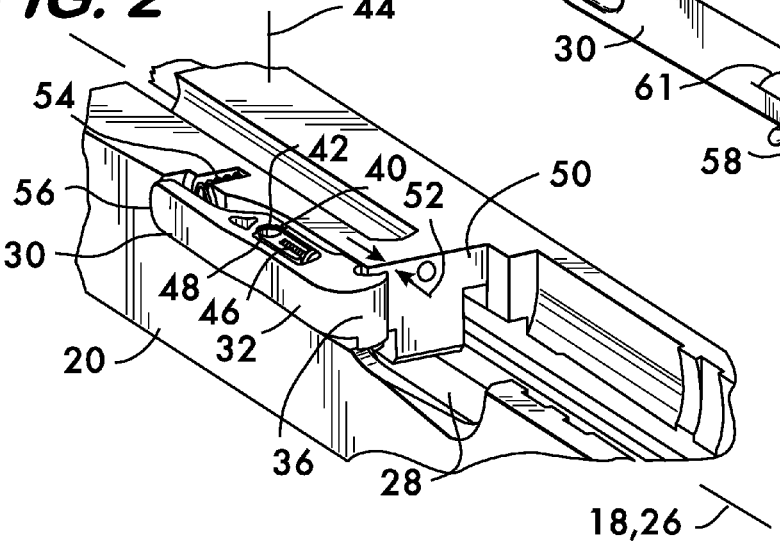
FIG. 2 is an isometric view of a portion of the firearm shown in FIG. 1 on an enlarged scale.

Extraction is effected by an extractor 30, shown in detail in FIGS. 2 and 2A. Extractor 30 comprises a body 32 that defines a longitudinal axis 34. A hook 36 is positioned at a first end 38 of the body 32. A first slot 40 is positioned within body 32, the slot 40 being positioned distal to the first end 38 and oriented parallel to the longitudinal axis 34 defined by the body 32. In this example the first slot 40 extends through body 32 and receives a pin 42 mounted on the slide 20 proximate to the opening 28, thereby positioning hook 36 adjacent to the opening 28. Pin 42 cooperates with the slot 40 to permit pivotal motion of the body 32 about rotational axis 44, and translational motion of the body 32 parallel to the longitudinal axis 34. These motions of the body 32 are relative to the slide 20. A second slot 46 is positioned in body 32 (see also FIG. 3), the second slot being contiguous with the first slot 40 and also oriented parallel to the longitudinal axis 34 of the extractor. A spring 48 is positioned within the second slot 46. Spring 48 acts between the pin 42 and the body 32 to bias the body along the longitudinal axis 34 and in a direction away from the breech face 50 mounted in the slide 20. Allowing the body 32 to move longitudinally along axis 34 permits the so-called "flag distance" 52 between the breech face 50 and the hook 36 to vary as necessary to ensure proper ammunition feeding and extraction. The flag distance for prior art extractors normally provides space between the hook 36 and the breech face 50 for the cartridge rim and some clearance, and it is advantageous to make the flag distance 52 as large as possible so that it reliably clears the rim of a cartridge as the cartridge moves from the magazine and into the barrel chamber during feeding. However, the flag distance 52 is limited by the available space between the breech face 50 and the face of the barrel 14 (not shown). As can be appreciated, it is a challenge to establish and maintain the proper flag distance for a fixed extractor. By allowing the extractor 30 to move along axis 34 relatively to the breech face 50, and biasing the hook 36 away from the breech face 50, a larger flag distance 52 can be established when it is needed during ammunition feeding, but the extractor will not prevent the slide from moving into battery because contact between the extractor 30 and the barrel face will move the extractor against its biasing spring 48 and toward the breech face 52 as necessary to permit the slide to return to battery, as described in more detail below.

A second spring 54 is mounted on the slide 20, the second spring being oriented transversely to the slide's longitudinal axis 26. Spring 54 acts between the slide 20 and a second end 56 of the extractor body 32, distal from the pin 42. Spring 54 thus biases the hook 36 in a direction toward the longitudinal axis 26 of the slide 20, as well as toward the firing axis 18 of the pistol 10 (see also FIG. 1). Allowing the body 34 to pivot about rotation axis 44 defined by the pin 42 permits the hook 36 to pass over and engage the rim of a cartridge which is already chambered as the slide 20 moves into battery. Spring 54 helps to ensure proper engagement between the hook 36 and the rim of a cartridge, as described below.

Figure 3:
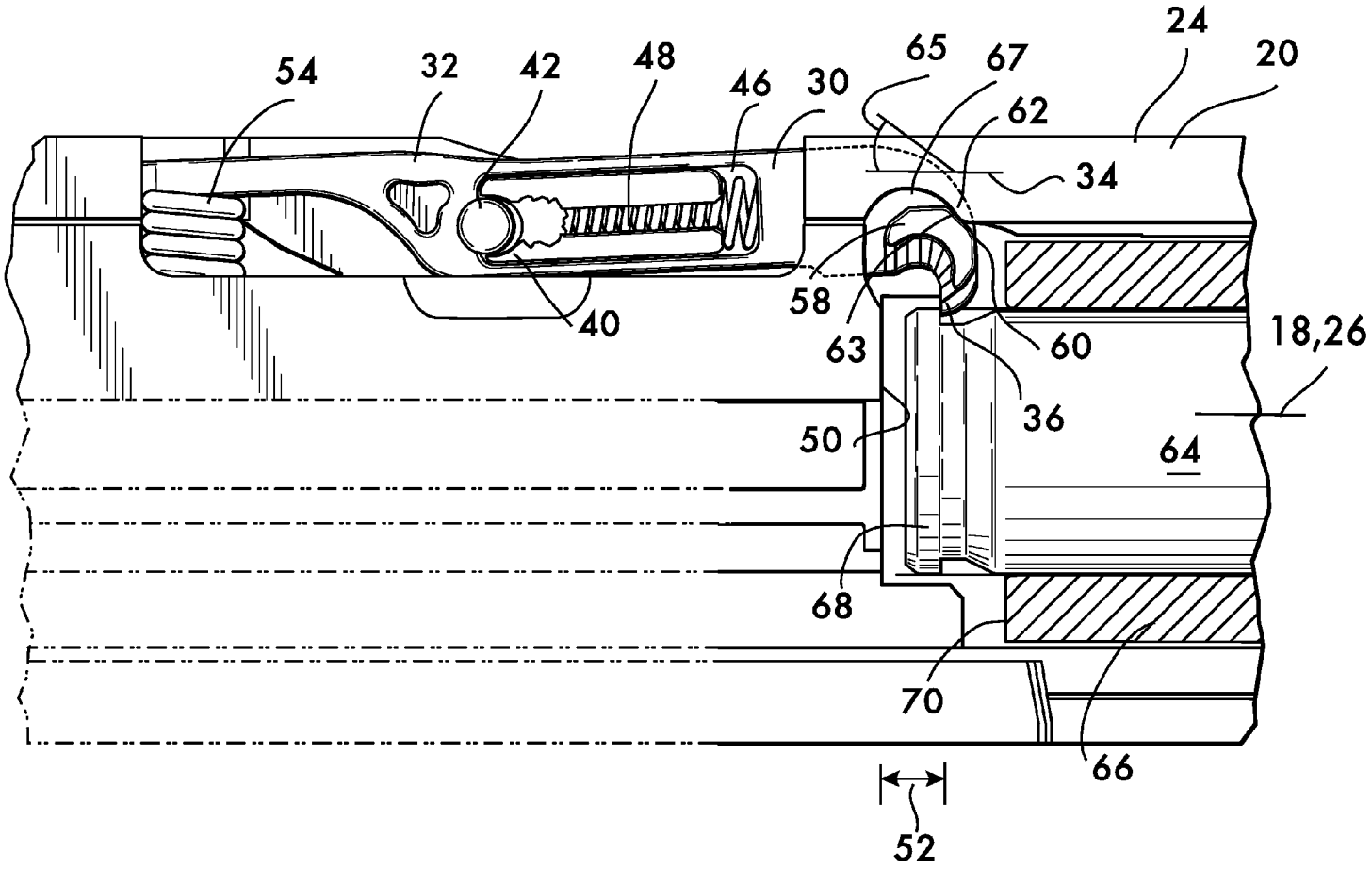
FIG. 3-5 are partial sectional views of a portion of the firearm according to the invention shown in FIG. 1.

As shown in FIG. 2A, a first cam follower 58 is located at the first end 38 of the body 32. In this example embodiment, cam follower 58 comprises a cam follower surface 60 that projects from the hook 36 transversely to the longitudinal axis 34. At least a portion 60*a* of cam follower surface 60 is oriented angularly relatively to the longitudinal axis 34 of body 32. In the example extractor 30 shown in FIG. 2A the surface portion 60A has an orientation angle 61 of about 45° . As shown in FIG. 3, cam follower 58 cooperates with a first cam 62 positioned on slide 20 adjacent to opening 28. First cam 62 comprises a cam surface 63 that faces toward the longitudinal axis 26 of the slide 20. Cam surface 63 may be angularly oriented with respect to the longitudinal axis 26. In the example shown, the orientation angle 65 of the cam surface is 45° , matched to the orientation angle 61 of the cam follower surface 60 (see FIG. 2A). A recess 67 in the sidewall 24 of the slide 20 is contiguous with the cam surface 63. Recess 67 helps define the cam 62 and permits motion of the hook 36 in a direction away from the firing axis 18 during action operation as described below.

FIG. 3 shows the action of pistol 10 during extraction. A cartridge 64 is in the chamber 66 of the barrel. Hook 36 of the extractor 30 is biased toward the firing axis 18 by spring 54 and engages the cartridge rim 68. Spring 48 biases the extractor body 32 away from the breech face 50 and maintains the cam follower 58 in engagement with the cam 62 on the slide 20. As the slide 20 moves out of battery and away from the barrel face 70 the hook 36 pulls on the rim 68 and extracts the cartridge 64 from the chamber 66. Any tendency of the hook 36 to pivot away from the firing axis 18 and ride up and over the rim 68 (and thereby fail to extract the cartridge 64) is prevented by the cam 62 as it engages the cam follower 58. Spring 48 biases the extractor body 32 toward the cam 62 and maintains the cam and cam follower 58 in engagement as the slide 20 moves out of battery. Without the cam 62 and cam follower 58, engagement between the hook 36 and the rim 68 would depend almost exclusively on the spring 54 biasing the hook 36 toward the firing axis 18. Use of the cam 62 and cam follower 58 allow the spring 54 to be less stiff than would otherwise be necessary if the spring 54 alone were to maintain the hook 36 in contact with the rim 68 to ensure extraction of cartridge 64.

Figure 4:
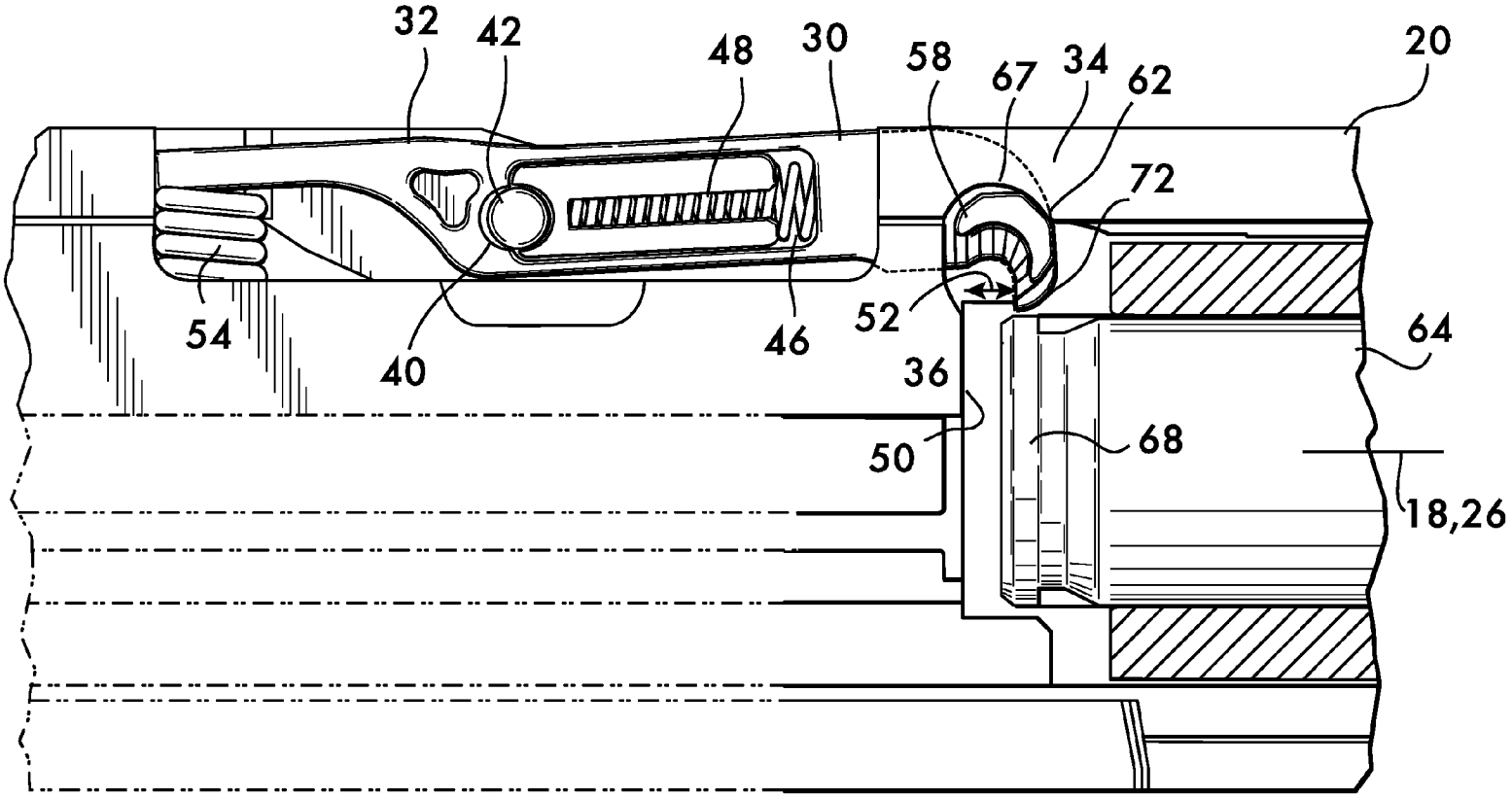
Figure 5:
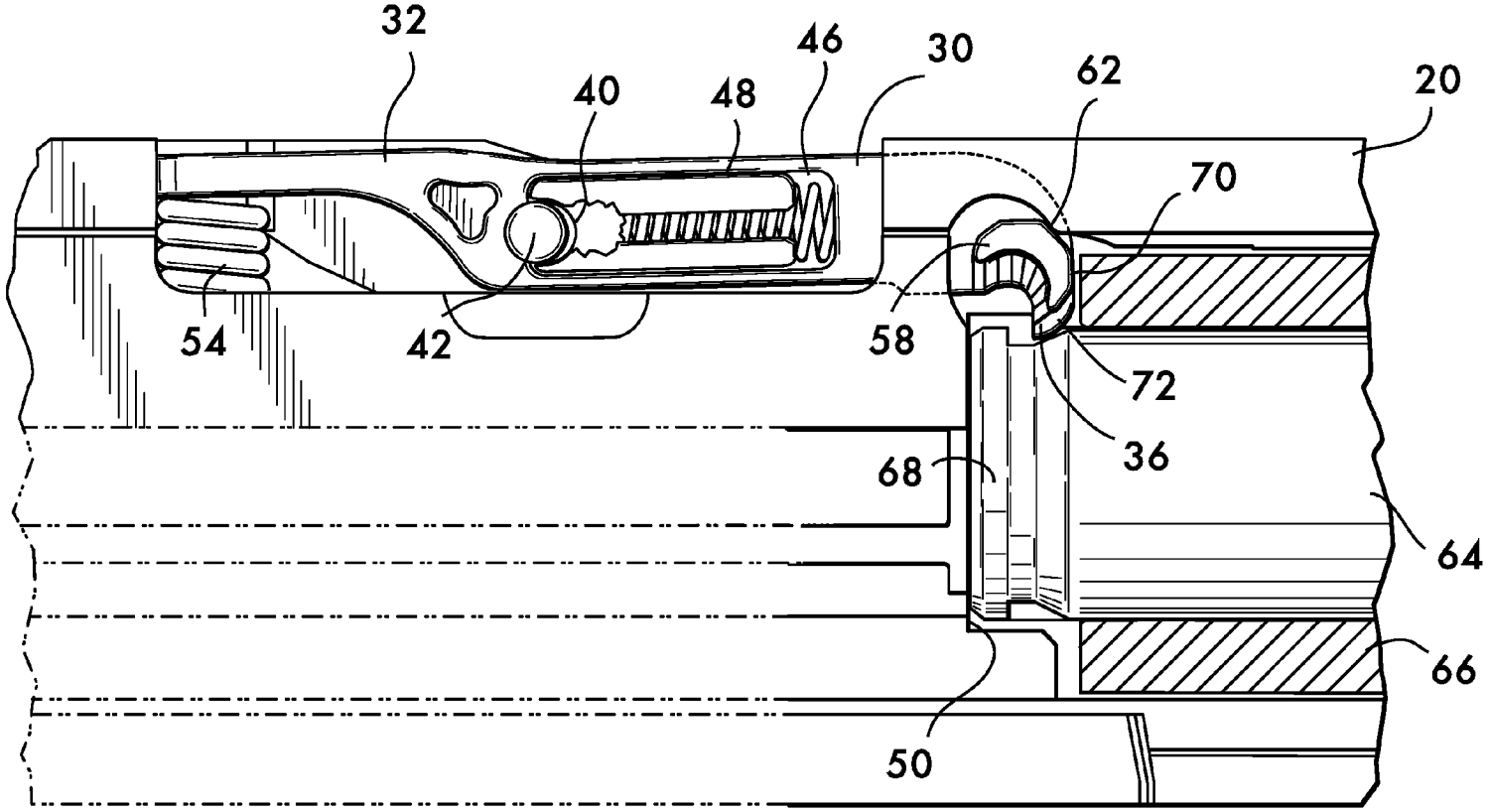

A less stiff spring 54 is advantageous when the slide 20 moves into battery because the drag on the slide caused by contact between the extractor and the cartridge is lower as a cartridge is stripped and fed into the chamber. A less stiff spring 54 is especially advantageous when a cartridge 64 is already present in the chamber 66 as the slide 20 moves into battery. For this condition, shown in FIG. 4, as slide 20 moves into battery, a second cam follower 72 positioned on the hook 36 engages the rim 68 of cartridge 64. The cam follower 72 is shaped so that the resultant force between the rim 68 and the extractor body 32 pushes the body 32 toward the breech face 50, compresses biasing spring 48, and pushes the hook 36 away from the firing axis 18. Slot 40 permits hook 36 to move relatively to the slide toward the breech face 50, but the hook 36 cannot initially pivot away from the firing axis 18 because the first cam follower 58 is still engaged with the cam 62 on the slide 20. As the body 32 moves relatively to the slide 20, with hook 36 moving toward the breech face 50, the first cam follower 58 on hook 36 eventually clears the cam 62 on the slide 20 and aligns with the recess 67 contiguous with the cam. This allows the hook 36 to pivot away from the firing axis 18, compressing spring 54 and clearing the rim 68. This configuration is captured in FIG. 4. Once the hook 36 clears the rim 68, the spring 54 biases it back toward the firing axis 18 and the hook 36 snaps over the rim 68. As the slide 20 attains battery (shown in FIG. 5), the second cam follower 72 may engage the barrel face 70, moving the hook 36 toward the breech face 50 and compressing the spring 48.

Figure 6:
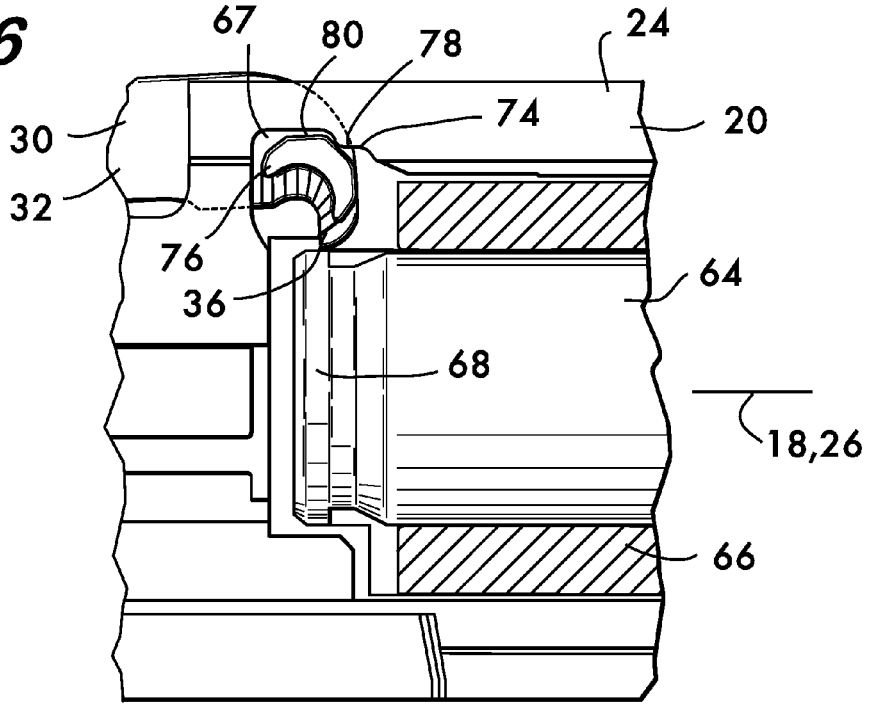
FIGS. 6 and 7 are partial sectional views of another embodiment of the firearm according to the invention.
Figure 7:
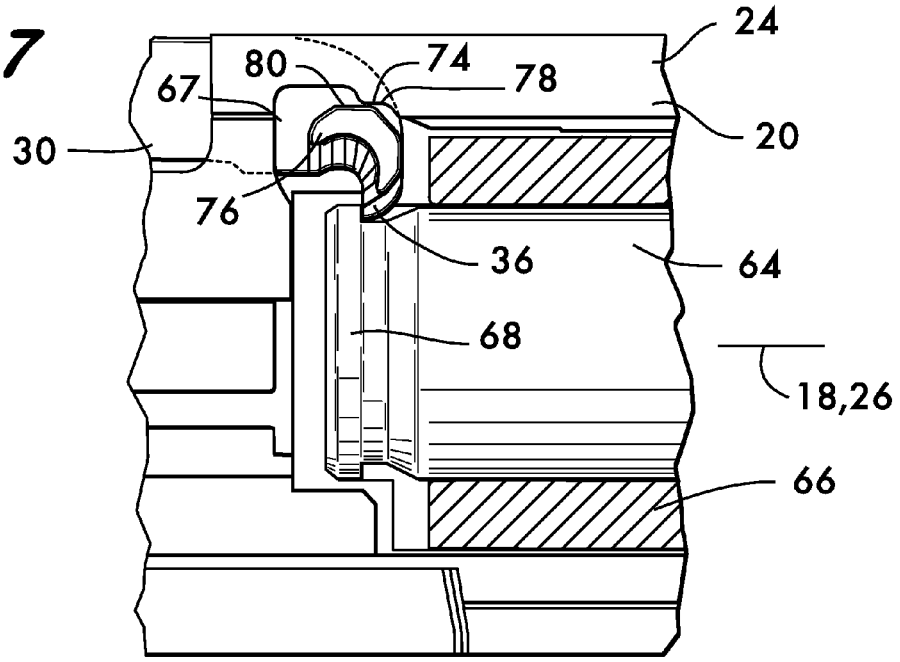

FIGS. 6 and 7 illustrate another embodiment of a cam 74 on slide 20 and a cam follower 76 on the extractor 30. Cam 74 comprises a cam surface 78 that is oriented substantially parallel to the longitudinal axis 26 of the slide 20. Cam surface 78 is positioned on sidewall 24 of slide 20 and faces the longitudinal axis 26. Cam follower 76 comprises a cam follower surface 80 that is also substantially parallel to the longitudinal axis 26. The recess 67 in sidewall 24 is again contiguous with the cam surface 78 and permits the extractor body 32 to pivot and move hook 36 away from the firing axis 18 (FIG. 6) so that the hook can clear the rim 68 of a cartridge 64 already within chamber 66 as the slide moves into battery. As shown in FIG. 7, the cam surface 78 of cam 74 cooperates with the cam follower surface 80 on cam follower 76 to prevent rotation of extractor body 32 (and hence motion of hook 36 away from the firing axis 18) to ensure that the hook remains engaged with the rim 68 of cartridge 64 during extraction.

The rotating and translating extractor according to the invention is expected to improve the functioning of auto-loading firearms by preventing the extractor from disengaging from the cartridge during extraction while enabling the extractor to snap over a cartridge when closing. This is accomplished using an extractor biasing spring with a lower spring constant, which reduces friction between the hook and the cartridge and hence facilitates closing of the slide. The invention also permits a larger flag distance which will lead to more reliable ammunition feeding as well as increased efficiency of production since the flag distance will no longer be a close tolerance dimension.

What is claimed is:

1. An extractor for an auto-loading firearm, said extractor comprising:

a body defining a longitudinal axis and having a hook at a first end thereof;

a first slot positioned in said body distal to said first end, said first slot being oriented parallel to said longitudinal axis;

a second slot contiguous with said first slot, said second slot being oriented parallel to said longitudinal axis; and a first cam follower located at said first end.

2. The extractor according to claim 1, wherein said body further comprises a second end opposite said first end, said first slot being positioned between said first and second ends.

3. The extractor according to claim 1, wherein said first slot extends through said body.

4. The extractor according to claim 1, wherein said first cam follower is positioned on said hook.

5. The extractor according to claim 4, wherein said first cam follower comprises a cam follower surface projecting from said hook transversely to said longitudinal axis.

6. The extractor according to claim 5, wherein at least a portion of said cam follower surface is oriented angularly relatively to said longitudinal axis.

7. The extractor according to claim 6, wherein said portion of said cam follower surface has an orientation angle of about 45° relatively to said longitudinal axis.

8. The extractor according to claim 5, wherein at least a portion of said cam follower surface is oriented substantially parallel to said longitudinal axis.

9. The extractor according to claim 4, further comprising a second cam follower positioned on said hook.

10. The extractor according to claim 1, further comprising a spring mounted within said second slot.

11. A slide for an auto-loading firearm, said slide comprising:

an elongate channel formed of a U-shaped sidewall and defining a longitudinal axis, said sidewall having an opening therein;

a first cam positioned on said slide adjacent to said opening;

an extractor body mounted on said slide and having first and second ends oppositely disposed, said extractor body being movable relatively to said slide in a direction parallel to said longitudinal axis;

a first cam follower located at said first end of said extractor body, said first cam follower being engageable with said first cam;

a first spring acting between said slide and said extractor body for biasing said extractor body into engagement with said first cam;

a hook positioned at said first end of said extractor body, said hook being positioned adjacent to said opening, said extractor body being pivotally mounted on said slide for motion of said hook toward and away from said longitudinal axis.

12. The slide according to claim 11, wherein said first cam comprises a cam surface positioned on said sidewall and facing toward said longitudinal axis.

13. The slide according to claim 12 , wherein said cam surface is angularly oriented with respect to said longitudinal axis.

14. The slide according to claim 13, wherein said cam surface has an orientation angle of about 45° relatively to said longitudinal axis.

15. The slide according to claim 12, further comprising a recess in said sidewall contiguous with said cam surface.

16. The slide according to claim 12, wherein said cam surface is oriented substantially parallel to said longitudinal axis.

17. The slide according to claim 16, further comprising a recess in said sidewall contiguous with said cam surface.

18. The slide according to claim 11, further comprising:

a pin mounted on said slide proximate to said opening;

a first slot positioned in said extractor body, said first slot being oriented parallel to said longitudinal axis and receiving said pin, said first slot and said pin cooperating to permit pivoting of said extractor body and motion thereof parallel to said longitudinal axis.

19. The slide according to claim 18, further comprising:

a second slot positioned in said extractor body, said second slot being contiguous with said first slot and oriented parallel to said longitudinal axis;

said first spring being positioned within said second slot and acting between said pin and said extractor body.

20. The slide according to claim 11, further comprising:

a second spring mounted on said slide; and wherein said first slot is positioned between said first and second ends of said extractor body, said second spring engaging said second end of said extractor body and thereby biasing said hook toward said longitudinal axis.

21. The slide according to claim 11, wherein said first cam follower is positioned on said hook.

22. The slide according to claim 21, wherein said first cam follower comprises a cam follower surface projecting from said hook transversely to said longitudinal axis.

23. The slide according to claim 22, wherein at least a portion of said cam follower surface is oriented angularly relatively to said longitudinal axis.

24. The slide according to claim 23, wherein said portion of said cam follower surface has an orientation angle of about 45° relatively to said longitudinal axis.

25. The slide according to claim 22, wherein at least a portion of said cam follower surface is oriented substantially parallel to said longitudinal axis.

26. The slide according to claim 11, further comprising a second cam follower positioned on said hook.

27. An auto-loading firearm, comprising:

a frame;

a barrel mounted on said frame and having a bore defining a firing axis;

a slide mounted on said frame and movable relatively thereto along said firing axis between an open position and a battery position, said slide having an opening therein;

a first cam positioned on said slide adjacent to said opening;

an extractor body mounted on said slide and having first and second ends oppositely disposed, said extractor body being movable relatively to said slide in a direction parallel to said firing axis;

a first cam follower located at said first end of said extractor body, said first cam follower being engageable with said first cam;

a first spring acting between said slide and said extractor body for biasing said extractor body toward said barrel and into engagement with said first cam;

a hook positioned at said first end of said extractor body, said hook being positioned adjacent to said opening, said extractor body being pivotally mounted on said slide for motion of said hook toward and away from said firing axis.

28. The auto-loading firearm according to claim 27, wherein said first cam comprises a cam surface positioned on said sidewall and facing toward said firing axis.

29. The auto-loading firearm according to claim 28, wherein said cam surface is angularly oriented with respect to said firing axis.

30. The auto-loading firearm according to claim 29, wherein said cam surface has an orientation angle of about 45° relatively to said firing axis.

31. The auto-loading firearm according to claim 28, further comprising a recess in said sidewall contiguous with said cam surface.

32. The auto-loading firearm according to claim 28, wherein said cam surface is oriented substantially parallel to said firing axis.

33. The auto-loading firearm according to claim 32, further comprising a recess in said sidewall contiguous with said cam surface.

34. The auto-loading firearm according to claim 27, further comprising:

a pin mounted on said slide proximate to said opening;

a first slot positioned in said extractor body, said first slot being oriented parallel to said firing axis and receiving said pin, said first slot and said pin cooperating to permit pivoting of said extractor body and motion thereof parallel to said firing axis.

35. The auto-loading firearm according to claim 34, further comprising:

a second slot positioned in said extractor body, said second slot being contiguous with said first slot and oriented parallel to said firing axis;

said first spring being positioned within said second slot and acting between said pin and said extractor body.

36. The auto-loading firearm according to claim 34, further comprising:

a second spring mounted on said slide; and wherein said first slot is positioned between said first and second ends of said extractor body, said second spring engaging said second end of said extractor body and thereby biasing said hook toward said firing axis.

37. The auto-loading firearm according to claim 27, wherein said first cam follower is positioned on said hook.

38. The auto-loading firearm according to claim 37, wherein said first cam follower comprises a cam follower surface projecting from said hook transversely to said firing axis.

39. The auto-loading firearm according to claim 38, wherein at least a portion of said cam follower surface is oriented angularly relatively to said firing axis.

40. The auto-loading firearm according to claim 39, wherein said portion of said cam follower surface has an orientation angle of about 45° relatively to said firing axis.

41. The auto-loading firearm according to claim 38, wherein at least a portion of said cam follower surface is oriented substantially parallel to said firing axis.

42. The auto-loading firearm according to claim 27, further comprising a second cam follower positioned on said hook, said second cam follower being engageable with said barrel.

43. The auto-loading firearm according to claim 27, wherein said firearm comprises a pistol.

* * * * *